United States Patent [19]

Moisar et al.

[11] 4,264,724

[45] Apr. 28, 1981

[54] EXPOSURE OF SILVER HALIDE EMULSIONS DURING FORMATION

[75] Inventors: Erik Moisar, Cologne; Friedrich Granzer, Langen; Detlev von Bock; Erhard Palm, both of Frankfurt, all of Fed. Rep. of Germany

[73] Assignee: AGFA-Gevaert, A.G., Leverkusen, Fed. Rep. of Germany

[21] Appl. No.: 919,797

[22] Filed: Jun. 28, 1978

[51] Int. Cl.[3] ..... G03C 1/02

[52] U.S. Cl. ..... 430/567; 430/569; 430/599

[58] Field of Search ..... 96/94 R, 108; 430/567, 430/569, 599

[56] References Cited

U.S. PATENT DOCUMENTS

| | | | |
|---|---|---|---|
| 3,206,313 | 9/1965 | Porter et al. | 96/108 |
| 3,852,072 | 12/1974 | Gerber et al. | 96/94 R |

FOREIGN PATENT DOCUMENTS 1027146 4/1966 United Kingdom .

*Primary Examiner*—Edward C. Kimlin

[57] ABSTRACT

Photographic silver halide emulsions with increased sensitivity are obtained by exposing the silver halide emulsions to an ionizing radiation during preparation, the exposure being terminated before the grains reach their final size.

6 Claims, No Drawings

EXPOSURE OF SILVER HALIDE EMULSIONS DURING FORMATION

This invention relates to a photographic silver halide emulsion in which the sensitivity is increased by sub-threshold preliminary exposure to ionising radiation at any stage during precipitation of the silver halide but before completion of this precipitation, so that the silver halide grains of the emulsion contain an outer zone of silver halide which is not exposed to this sub-threshold radiation.

Photographic silver halide emulsions are adjusted to the desired sensitivity to light by physical or chemical measures. In practice, it is generally desired to combine the highest possible sensitivity with the least possible fog. The increase in sensitivity is mainly achieved by so-called physical ripening and chemical ripening or after-ripening.

Other measures for increasing the sensitivity are also known, but they have achieved very limited, if any importance in practice. These measures include the sensitization of photographic silver halide layers by a sub-threshold diffuse preliminary exposure. When a layer has been subjected to such a preliminary exposure, it is more sensitive to a second, imagewise exposure than an identical layer which has not been subjected to this preliminary treatment.

By "sub-threshold" is meant an exposure which on its own, does not render the photographic layer developable to any significant extent. This diffuse preliminary exposure may be carried out, for example, with light as described by P. C. BURTON and W. F. BERG, Phot.J. 86 B, 2 (1946) or with ionizing radiation, e.g. X-rays or γ-rays, as described by D. R. CALLABY, J.Photogr.-Sci. 20, 157 seq. (1972).

The so-called sub-latent image nuclei produced by such preliminary exposure to light or other radiation differ considerably in their action and consequently also in their size and nature, from the ripening nuclei produced by chemical ripening, e.g. with gold and/or sulphur.

According to U.S. Pat. No. 3,852,072, the effect of the sub-threshold preliminary exposure to high energy radiation, is utilized by incorporating a radioactive preparation in the finished layer. This is said to increase the sensitivity of the layer, but it can hardly be of any practical importance since it is extremely difficult, when incorporating radioactive preparations in a photographic layer, to prevent excessive fogging which would be liable to cause spontaneous development and thereby render the photographic layer unusable. Another reason why the effect of increasing the sensitivity by sub-threshold diffuse preliminary exposure with high energy radiation has not acquired any importance in practice is that the effect achieved is considerably less than the increase in sensitivity achieved by conventional measures, particularly chemical ripening. It was not possible to employ a combination of the known measures because silver halide emulsions which have been subjected to sub-threshold preliminary exposure as described above undergo such severe fogging when subsequently ripened by chemical means that they become unusable. It is an object of this invention to provide photographic silver halide emulsions which have increased sensitivity. Photographic silver halide emulsions with increased sensitivity have now been found, which are obtained by exposing the silver halide emulsions to an ionising radiation at any stage of their preparation, this exposure to radiation being carried out for varying lengths of time and at various stages of the preparation process according to the effect desired by always in such a manner that it is terminated before the silver halide grains reach their final size, so that the grain contains an outer phase of silver halide which has not been exposed to sub-threshold radiation.

The exposure to radiation may be continued throughout the precipitation process or it may be carried out intermittently, for example by interrupting precipitation and then irradiating the emulsion obtained at the moment when precipitation was interrupted, and then continuing the precipitation process without irradiation. The only necessary condition is that the exposure to radiation must be stopped before the silver halide crystals have reached their final size. The exposure to radiation may be carried out within a wide temperature range.

The ionising rays employed may be high energy electron rays, X-rays, or, preferably, γ-rays, e.g. of a radioactive element.

The silver halide emulsion according to the invention contains silver halide grains up to 99% by volume of which may contain, in their interior, sub-image nuclei obtained by the irradiation with ionising rays according to the invention. This means that exposure to the high energy rays must be stopped at the latest when the emulsion grains have reached 98% by volume, and preferably when they have reached 50 to 95% by volume of their final size.

The duration and intensity of irradiation should be calculated so that when a sample which has been taken immediately after irradiation was stopped but before further precipitation of the emulsion, is cast on a layer substrate, dried and developed without further exposure to light in a developer of the following composition (5 minutes at 20° C.):

p-Methylaminophenol—1 g
Hydroquinone—3 g
Sodium sulphite—13 g
Sodium carbonate—26 g
Potassium bromide—1 g
Water to make up to 1000 ml. the quantity of silver developed in the sample corresponds to at the most 20%, preferably from 1 to 10%, of the quantity of silver halide in the layer.

This means that the silver halide grains have not become spontaneously developable to full intensity by the sub-threshold preliminary exposure.

The emulsion according to the invention may consist of a single halide, e.g. of chloride or bromide, or of a halide mixture and the halides may also contain silver iodide, in particular up to 10 mol %.

In the case of mixed silver halides, the mixed halide may be uniformly distributed within the grain or the individual halides may be present in different concentrations within the grain. Emulsions of the last mentioned type may be prepared, for example, by the processes described in German Pat. No. 1,169,290; British Pat. No. 1,027,146 or German Offenlegungsschriften Nos. 2,308,239 and 2,332,802.

Both homodisperse silver halide emulsions and heterodisperse emulsions may be prepared by the process according to the invention.

By "homodisperse emulsions" are meant those which have a narrow grain size distribution. Preferably, about 95% by weight of the silver halide grains of such emulsions have a diameter which deviates by not more than 40%, preferably not more than 30%, from the average grain diameter. The silver halide grains may have any of the known forms, e.g. they may be cubical, octahedric or mixed tetradecahedric.

By "heterodisperse emulsions" are meant in particular emulsions which have a relatively wide distribution of grain sizes. Preferably at least 10% by weight, more preferably at least 20% by weight of the silver halide grains in such emulsions have a diameter which deviates by at least 40% from the average grain diameter. The silver halide grains of heterodisperse emulsions are mainly irregular in shape.

The absolute value of the average grain size of the emulsions according to the invention or of the emulsions prepared by the process according to the invention may vary within wide limits. Both fine-grained silver halide emulsions having an average grain diameter below 0.5 μm, preferably below 0.3 μm, and coarse-grained emulsions with average grain diameters of between 0.5 and 4 μm may be prepared, according to the intended purpose for which the photographic material is to be used.

The known principles of preparing silver halide emulsions, as regards the conditions of precipitation and ripening can be applied. Thus, in the case of heterodisperse emulsions, a suitable aqueous halide solution having a certain gelatine content would generally be provided and an aqueous silver salt solution, generally an aqueous silver nitrate solution, would be added with stirring. The process may be modified in various ways as regards the temperature, pH or pAg values, depending on the intended use and nature of the emulsion.

Alternatively, the so-called double inflow process may be employed, particularly for the preparation of homodisperse emulsions. Suitable processes of this type have been described in British Pat. No. 1,027,146 and in the publication by E. KLEIN and E. MOISAR "Berichte der Bunsengesellschaft für physikalische Chemie," 67 (1963), pages 349–355.

The usual hydrophilic film formers may be used as protective colloids or binders for the silver halide emulsion layer, for example proteins, in particular gelatine, alginic acid or its derivatives such as its esters, amides or salts, cellulose derivatives such as carboxymethyl cellulose and cellulose sulphates, starches or derivatives thereof or hydrophilic synthetic binders such as polyvinyl alcohol, partially saponified polyvinylacetate or polyvinylpyrrolidone. Mixed with the hydrophilic binders, the layers may contain other synthetic binders in the form of solutions or dispersions, such as homopolymers or copolymers of acrylic or methacrylic acid or derivatives thereof, such as the esters, amides or nitriles, or vinyl polymers such as vinyl esters or vinyl ethers.

The usual substrate layers may be used for the emulsions according to the invention, e.g. substrates of cellulose esters such as cellulose acetate or cellulose acetobutyrate, or polyesters, in particular polyethylene terephthalate or polycarbonates, especially those based on bis-phenylolpropane. Paper substrates may also be used, and these may contain water impermeable polyolefin layers, e.g. layers of polyethylene or polypropylene. Glass or metal substrates may also be used.

Since the emulsions according to the invention can be used as negative emulsions with high and maximum sensitivity in one preferred embodiment, the silver halide emulsions which are processed in the usual manner after precipitation can be chemically ripened to its optimum sensitivity on the surface. This may be carried out by any of the three main processes known for chemical sensitization, namely ripening with noble metals and/or with sulphur compounds, optionally also with selenium or tellurium compounds, or reduction ripening. The emulsions may, of course, also be treated in known manner by the addition of active gelatine containing certain ripening compounds of the sulphur groups. Methods of this type are known in the literature, and they have been disclosed for example, in U.S. Pat. Nos. 1,574,944; 1,623,499 and 2,410,689.

The compounds used for ripening with noble metals are mainly gold compounds but also compounds of metals of group VIII of the Periodic System, e.g. ruthenium, rhodium, palladium, iridium or platinum. Suitable salts of these metals include potassium chloroaurite; potassium aurothiocyanate; potassium chloroaurate; gold trichloride; aluminium chloropalladate; potassium chloroplatinate and sodium chloropalladite.

The sulphur compounds used are mainly thiosulphates, thiocyanates and organic sulphur compounds.

The known methods may be used for reduction ripening, e.g. ripening with tin (II) salts, polyamine, e.g. diethylenetriamine, or bis(β-aminoethyl)-sulphid.

The negative silver halide emulsions of the type described above have a preferential surface sensitivity. Such emulsions are generally characterised by optimal chemical ripening of the surface.

The process according to the invention and the emulsions according to the invention are, however, also suitable for the preparation of emulsions of the internal nuclear type, i.e. those which, either preferentially or in addition, have a high internal sensitivity. According to the invention, such emulsions are prepared by continuously or intermittently irradiating during the process of preparation and chemically ripening either at the same time or during subsequent precipitation without irradiation, or producing a halide phase boundary to increase the internal sensitivity. Lastly, the layered grain structures produced in this way are precipitated to their final size. Such grains with a layered grain structure or halide phase boundaries have been described in the above mentioned German Pat. No. 1,169,290 and in German Offenlegungsschriften Nos. 2,308,239 and 2,332,802.

As will be clear from what has been said above, the emulsions according to the invention or emulsions produced by the process according to the invention may be used in a wide variety of ways. They are preferably used as high sensitivity negative emulsions but may also be used for the preparation of unfogged direct positive silver halide emulsions, i.e. emulsions which have a relatively high internal grain sensitivity without a surface fog. Such emulsions may be chemically sensitized on the surface to a certain extent, and they are developed under fogging conditions.

The silver halide emulsions prepared by the process according to the invention may contain the usual emulsions additives, depending on the type of emulsion and the purpose for which it is to be used.

The emulsions may contain the usual stabilisers, e.g. homopolar compounds or salts of mercury containing aromatic or heterocyclic rings, such as mercaptotriazoles, simple mercury salts, sulphonim mercury double salts and other mercury compounds. Azaindenes are also suitable stabilisers, particularly tetra-and penta-azaindenes and especially those which are substituted with hydroxyl or amino groups. Compounds of this type have been described in the article by Birr, Z. Wiss.

Phot., 47(1962), pages 2 to 58. Other suitable stabilisers include, inter alia, heterocyclic mercapto compounds, e.g. phenylmercaptotetrazole, quaternary benzothiazole derivatives and benzotriazole.

Further suitable stabilizers have been described in German Offenlegungsschrift No. 2 416 814.

The emulsions may also be spectrally sensitized. The usual monomethine or polymethine dyes such as acid or basic cyanines, hemicyanines, steptocyanines, merocyanines, oxonoles, hemioxonoles and styryl dyes, as well as trinuclear or higher nuclear methine dyes such as rhodacyanines or neocyanines are suitable for this purpose. Sensitizers of this type have been described, for example, in the work by F. M. Hamer, "The Cyanine Dyes and Related Compounds" (1964), Interscience Publishers, John Wiley and Sons.

The present invention may be applied both to the production of black and white images and to the production of colour photographic images. The process for which the photographic material is used may vary, for example, according to the gradation of the silver halide emulsion layer, steep gradations being suitable for phototechnical purposes while medium or flat gradations are suitable for the production of black-and-white continuous-tone images or X-ray photographs. Coloured photographic images may be produced, for example, according to the known principle of chromogenic development in the presence of colour couplers which react with the oxidation product of colour-producing p-phenylenediamine developers to form dyes.

These colour couplers may be added to the silver halide emulsion layers or the colour coupler may be added according to the principle of the so-called incorporation development process.

Incorporation of the colour couplers in the emulsion layer may be carried out by the usual methods, for example, water soluble colour couplers which contain one or more sulpho or carboxyl groups in the form of the free acid or of a salt may be added to the casting solution for the emulsion from an aqueous solution, optionally in the presence of an alkali. Colour couplers which are insoluble or insufficiently soluble in water are added in the form of a solution in a suitable high boiling, oil-forming or low boiling organic solvent or solvent mixture, which may or may not be miscible with water. This solution may be dispersed in the aqueous solution of a protective colloid, optionally in the presence of a surface active agent.

The emulsions according to the invention may be used in known manner for instant colour development processes or colour transfer processes. In these processes, the dyes for the partial colour images diffuse into an image receiving layer where they became firmly fixed, or the colour couplers diffuse into the image receiving layer where they are converted to the image dye after the usual colour producing development. Colour transfer processes and couplers used in such processes have also been described in U.S. Pat. Nos. 2,983,606; 3,087,817; 3,185,567; 3,227,550; 3,227,551; 3,227,552; 3,227,554; 3,253,915, 3,415,644; 3,415,645 and 3,415,646.

The emulsions according to the invention may also be used for colour transfer processes in which the particular layer also contains a diffusion resistant compound constituting a dye or dye precursor from which a diffusible dye, preferably one containing acid groups, is released by the oxidation products of the photographic developers produced in imagewise distribution when development is carried out in the presence of the alkaline processing material.

Various chemical compounds are available for this purpose. The diffusion resistant colour producing substances according to U.S. Pat. No. 3,628,952, for example, are particularly suitable. These compounds split off diffusible dyes when they react with the oxidation products of black and white developers or colour developers. Another useful series of compounds has been described in German Pat. No. 1,095,115. When these compounds react with oxidized colour developer, they give rise to diffusible dyes generally belonging to the azomethine dye series. Another suitable colour producing system has been described in U.S. Pat. Nos. 3,443,939 and 3,443,940. In this system, diffusible dyes are split off by reaction with oxidized developer substances which is accompanied by ring closure.

The invention will now be further described with reference to the following Examples.

EXAMPLE 1

A homodisperse silver bromide emulsion having a cubical crystal structure and a particle size of 0.3 μm was prepared by the double inflow of potassium bromide and silver nirate solutions under controlled conditions at a pAg value of 6.8 and a pH of appr. 5.

This emulsion used as starting emulsion was divided into portions. Comparison emulsion (A) was prepared from one portion of the starting emulsion by continuing the process of precipitation by pAg-controlled double inflow of a 3 N silver nitrate solution, adjusted by nitric acid to pH=3.0, and a 3 N potassium bromide solution, the quantity of silver bromide produced in this second stage of precipitation amounting to 25% of the quantity of silver bromide present in the starting emulsion.

To prepare the emulsion (B) according to the invention, an aliquot portion of the starting emulsion was exposed to a cobalt 60 source of γ-radiation for 30 minutes at approximately 10° C. The activity of the emitter was about $1.1\times10^9$ $s^{-1}$ and the distance between the source of radiation and the emulsion about 0.4 m. After irradation had been terminated, precipitation was continued in the same way as in comparison emulsion (A). Both emulsions were cast on film supports in the usual manner, exposed behind a grey wedge and developed for five minutes in a developer having the composition previously indicated. The threshold sensitivities recorded at a density of S=0.1 were as follows:

Emulsion (A)—13 stages (0.1)

Emulsion (B)—16 stages.

Emulsion (B) according to the invention therefore has a higher sensitivity by 0.3 log It units.

EXAMPLE 2

An emulsion was precipitated by the addition of a solution of 200 g of silver nitrate in 2 liters of water to a solution of 10 g of gelatine, 130 g of ammonium bromide and 16 g of potassium iodide in 2 liters of water. The precipitated emulsion was freed from soluble salts by the usual method of flocculating and, after redispersion in a solution of 200 g of gelatine in 2 liters of water, it was used as starting emulsion.

340 ml of 1 N silver nitrate, adjusted to pH=3.0 with nitric acid, and 120 ml of 3 N potassium bromide were added to 900 g of the starting emulsion by a process of double inflow for thirty minutes at 60° C. The resulting emulsion was used as comparison emulsion (C). To prepare the emulsion (D) according to the invention, a further 900 g of the starting emulsion were exposed to a cobalt 60 source of $\gamma$-radiation at approximately 10° C. The activity of the emitter was $8.6\times10^{10}$ $S^{-1}$ and the distance between the source of radiation and the emulsion was about 0.4 m. After irradiation was terminated, precipitation was continued as for comparison emulsion (C). Both emulsions were then ripened at 50° C. for 120 minutes, after the addition of 9 ml of $2.5\times10^{-4}$ mol of $Na_3Au(S_2O_3)_2$ solution per 150 g of emulsion. The ripened emulsions were then cast on film supports, exposed behind a grey wedge and developed for five minutes in the developer specified above.

The threshold sensitivities recorded at a density of S=0.1 were as follows:

Emulsion (C)—21 stages (0.1)

Emulsion (D)—25 stages

The emulsion (D) according to the invention therefore had a higher sensitivity by 0.4 log It units.

We claim:

1. In the process of producing a photographic silver halide gelatin emulsion having grains of emulsion containing in their interior, sub-latent image nuclei for providing sensitivity upon exposure to light, the steps of, first, mixing components including an aqueous solution of a silver salt and an aqueous solution of an alkali metal halide in proportion which forms a precipitate emulsion of a silver halide in aqueous solution in a protective colloid and during the formation of said emulsion exposing the emulsion to ionizing radiation emanating from a source of said radiation located at a distance from the emulsion to produce an emulsion having sub-latent nuclei in the silver halide grains and which upon development without further exposure with a developer of the following compositions:

p-methylaminophenol—1 g
hydroquinone—3 g
sodium sulphite—13 g
sodium carbonate—26 g
potassium bromide—1 g
made up with water to 1000 ml at a devleopment temperature of 20° C. and a development time of 5 minutes, yields a quantity of not more than 20% of reduced silver from the silver halide emulsion of said precipitate emulsion, and second, continuing mixture of said components of a silver salt and aqueous solution of an alkali metal halide in proportion which forms the precipitate of silver halide in aqueous solution, in the absence of radiation to produce silver halide grains having an outer phase lacking nuclei, the grains in their final size containing not more than 98% by volume in the portion containing the nuclei.

2. A process as claimed in claim 1 in which irradiation is carried out with $\gamma$-rays or X-rays.

3. A process as claimed in claim 1 in which irradiation is carried out continuously or intermittently during precipitation.

4. A process as claimed in claim 1 in which after precipitation, chemical ripening on the surface is carried out.

5. A process as claimed in claim 1 wherein from 50 to 95% by volume of said grains in their final size contain the portion containing the nuclei.

6. In the process of producing a photographic silver halide gelatin emulsion having grains of emulsion containing in their interior, sub-latent image nuclei for providing sensitivity upon exposure to light said grains having an outer phase free of said sub-latent nuclei the steps of, first, mixing components including an aqueous solution of a silver salt and an aqueous solution of an alkali metal halide in proportion which forms a precipitate emulsion of a silver halide in aqueous solution in a protective colloid and during the formation of said precipitate emulsion exposing the emulsion to ionizing radiation emanating from a source of said radiation located at a distance from the emulsion to produce an emulsion having sub-latent nuclei in the silver halide grains and which upon development without further exposure with a developer of the following compositions:

p-methylaminophenol—1 g
hydroquinone—3 g
sodium sulphite—13 g
sodium carbonate—26 g
potassium bromide—1 g
made up with water to 1000 ml at a development temperature of 20° and a development time of 5 minutes, yields a quantity of not more than 20% of reduced silver from the silver halide emulsion of said precipitate emulsion, and second, continuing mixing said components of a silver salt and aqueous solution of an alkali metal halide in proportion which forms the precipitate of silver halide in aqueous solution, in the absence of radiation to produce silver halide grains having an outer phase lacking nuclei.

* * * * *